US006860591B2

(12) United States Patent
Slotto et al.

(10) Patent No.: US 6,860,591 B2
(45) Date of Patent: Mar. 1, 2005

(54) INK CONTAINER

(75) Inventors: Steven R. Slotto, Vancouver, WA (US); Garry A. Jones, Molalla, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/375,462

(22) Filed: Feb. 27, 2003

(65) Prior Publication Data

US 2004/0169706 A1 Sep. 2, 2004

(51) Int. Cl.[7] ..... B41J 2/175
(52) U.S. Cl. ..... 347/85; 347/88
(58) Field of Search ..... 347/85, 86, 87, 347/88, 92; 101/365; 106/31.29; 401/40

(56) References Cited

U.S. PATENT DOCUMENTS 3,720,473 A * 3/1973 Nakata ..... 401/40
4,694,307 A 9/1987 Toganoh et al. ..... 346/140
4,814,786 A 3/1989 Hoisington et al. ..... 346/1.1
5,123,961 A * 6/1992 Yamamoto ..... 106/31.29
5,485,187 A * 1/1996 Okamura et al. ..... 347/85
5,621,444 A * 4/1997 Beeson ..... 347/88
5,886,718 A * 3/1999 Johnson et al. ..... 347/85
5,917,526 A * 6/1999 Wilson et al. ..... 347/86
6,007,193 A * 12/1999 Kashimura et al. ..... 347/92
6,022,102 A * 2/2000 Ikkatai et al. ..... 347/85
6,213,596 B1 * 4/2001 Nowell, et al. ..... 347/85
6,516,721 B1 * 2/2003 Voge ..... 101/365

FOREIGN PATENT DOCUMENTS

EP 0 847 862 A1 6/1998

OTHER PUBLICATIONS

European Search Report, May 6, 2004, 3 pages.

* cited by examiner

*Primary Examiner*—Anh T. N. Vo
(74) *Attorney, Agent, or Firm*—Manual Quiogue

(57) ABSTRACT

An ink container that includes a first ink chamber for containing ink, a second ink chamber fluidically connected to the first ink chamber for receiving ink from the first ink chamber, a one-way valve for permitting a flow of ink from the first ink chamber to the second ink chamber, an ink supply conduit connected to the second ink chamber, and a mechanism for selectively pressurizing the second ink chamber.

17 Claims, 4 Drawing Sheets

INK CONTAINER

BACKGROUND OF THE DISCLOSURE

The subject disclosure is generally directed to ink jet printing, and more particularly to an ink container that supplies melted solid ink to a plurality of ink jet printheads.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper. Some ink jet printheads employ melted solid ink.

DETAILED DESCRIPTION OF THE DISCLOSURE

Figure 1:
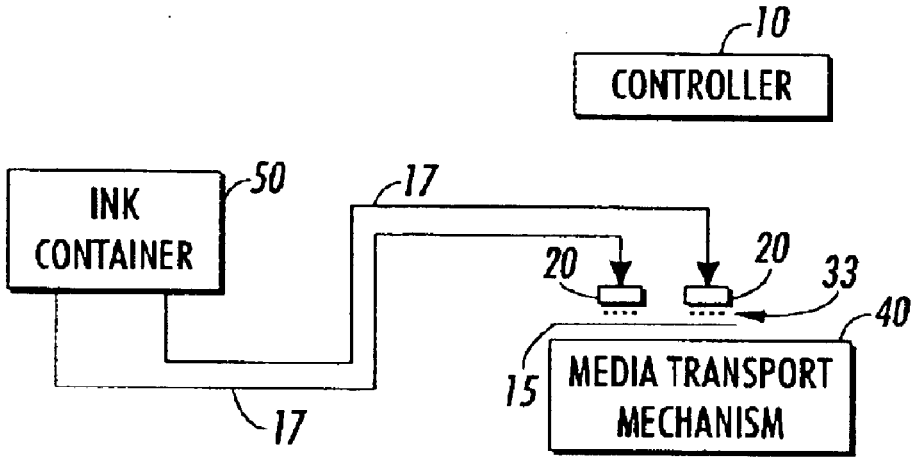
FIG. 1 is a schematic block diagram of an embodiment of an ink jet printing apparatus that includes an ink container that distributes ink to a plurality of ink jet printheads.

FIG. 1 is a schematic block diagram of an embodiment of an ink jet printing apparatus that includes a controller 10, a plurality of printhead assemblies 20 that can include a plurality of drop emitting drop generators for emitting drops of ink 33 onto a print output medium 15. A print output medium transport mechanism 40 can move the print output medium relative to the printhead assemblies 20. The printhead assemblies 20 receive ink from an ink container 50 via ink supply conduits 17. The ink container 50 can contain melted solid ink and the ink supply conduits 17 can comprise heated conduits such as heated tubes.

Figure 2:
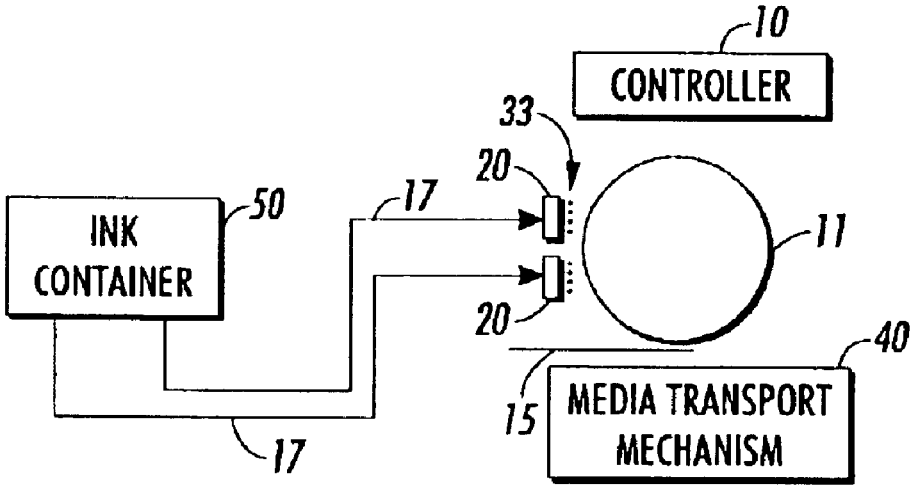
FIG. 2 is a schematic block diagram of an embodiment of another ink jet printing apparatus that includes an ink container that distributes ink to a plurality of ink jet printheads.

FIG. 2 is a schematic block diagram of an embodiment of an ink jet printing apparatus that includes a controller 10, a plurality of printhead assemblies 20 that can include a plurality of drop emitting drop generators for emitting drops of ink, for example, and a transfer drum 11 for receiving the drops emitted by the printhead assemblies 20. A print output media transport mechanism 40 rollingly engages an output print medium 15 against the transfer drum 11 to cause the image printed on the transfer drum 11 to be transferred to the print output medium 15. The printhead assemblies receive ink from an ink container 50 via ink supply conduits 17. The ink container 50 can contain melted solid ink and the ink supply conduits 17 can comprise heated conduits such as heated tubes.

In the embodiments illustrated in FIGS. 1 and 2, the controller 10 selectively energizes the drop generators by providing a respective drive signal to each drop generator of the printhead assemblies 20. Each of the drop generators can employ a piezoelectric transducer. As other examples, each of the drop generators can employ a shear-mode transducer, an annular constrictive transducer, an electrostrictive transducer, an electromagnetic transducer, or a magnetorestrictive transducer. Each of the printhead assemblies 20 can be formed of a stack of laminated sheets or plates, such as of stainless steel.

Figure 3:
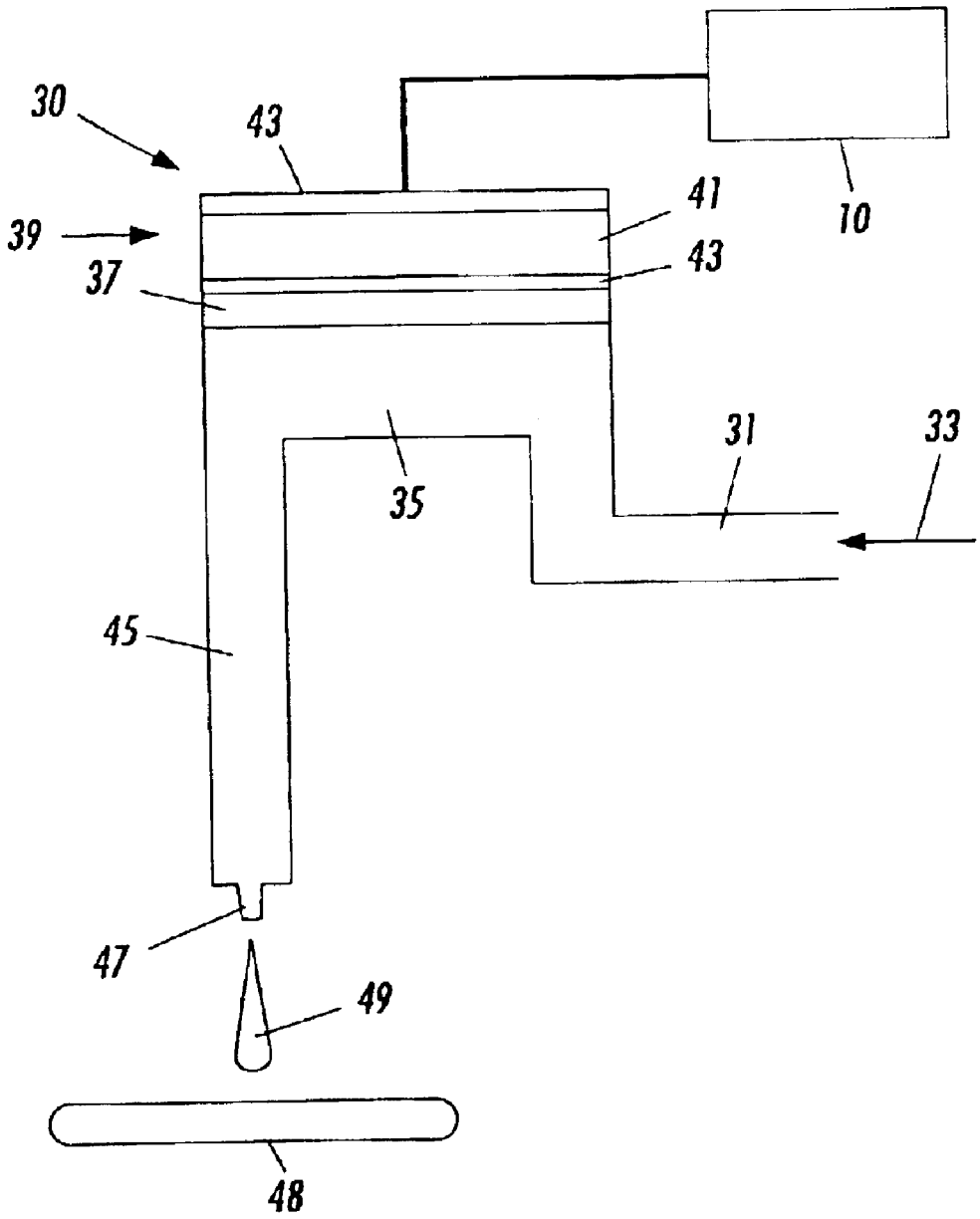
FIG. 3 is a schematic block diagram of an embodiment of a drop generator that can be employed in the ink jet printing apparatus shown in FIGS. 1 and 2.

FIG. 3 is a schematic block diagram of an embodiment of a drop generator 30 that can be employed in the printhead assemblies 20 of the printing apparatus shown in FIG. 1. The drop generator 30 includes an inlet channel 31 that receives melted solid ink 33 from a manifold, reservoir or other ink containing structure. The melted ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface or a print output medium, for example. The outlet channel 45 can include a nozzle or orifice 47.

Figure 4:
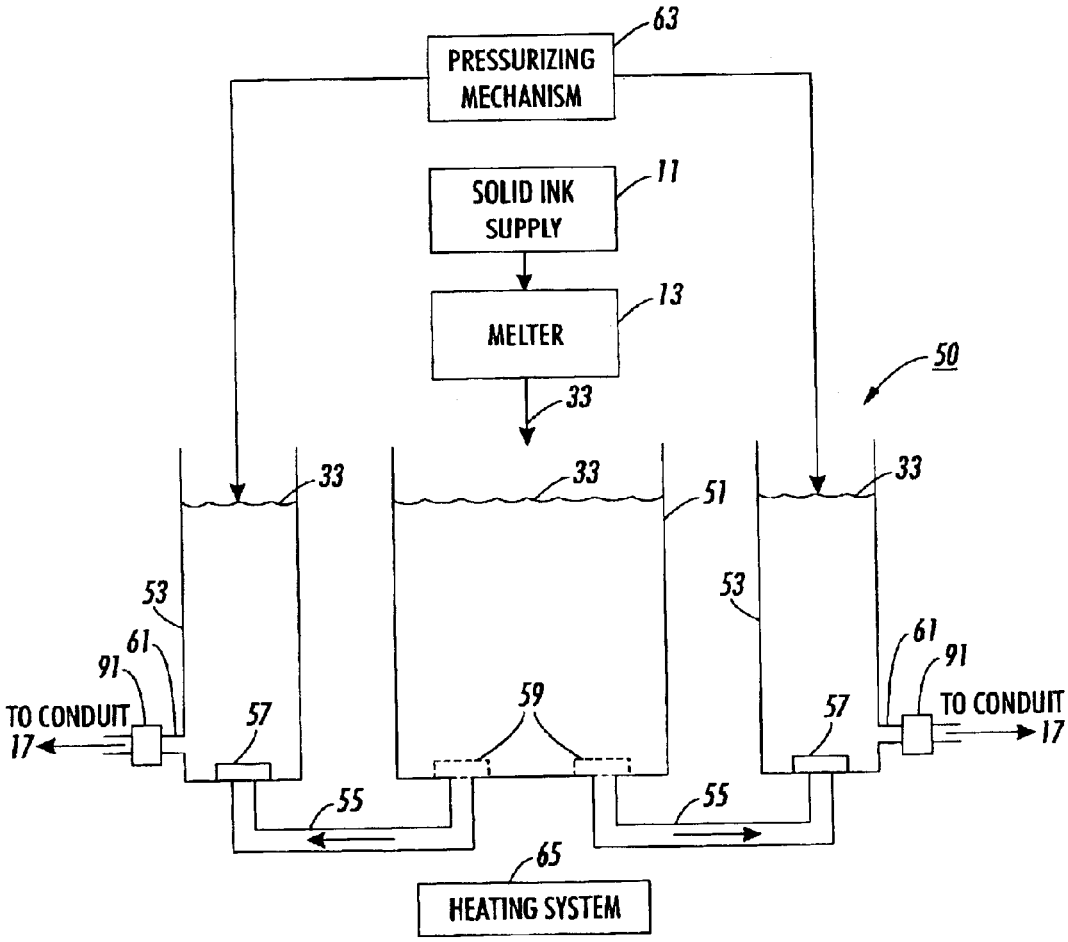
FIG. 4 is a schematic block diagram of an embodiment of the ink container of the ink jet printing apparatus shown in FIGS. 1 and 2.

FIG. 4 is a schematic block diagram of an embodiment of the ink container 50 of the ink jet printing apparatus of FIG. 1. The ink container 50 includes a main ink chamber 51 for receiving melted solid ink 33 from a solid ink melter 13 which receives solid ink from a solid ink supply 11. The ink melter can comprise a heat plate for example and can be attached to the ink container 50. The ink container further includes a plurality of ink refill chambers 53, and a plurality of conduits 55 disposed between the main ink chamber 51 and respective ink refill chambers 53. The ends of each conduit 55 are respectively connected to a lower portion of the main ink chamber 51 and a lower portion of an associated ink refill chamber 53. A one-way valve 57 is disposed at an end of each conduit 55, for example at the ink refill chamber end, for permitting flow of ink only into the refill chamber. A filter 59 can be disposed at the end of each conduit 55 at the main ink chamber 51.

Each refill chamber 53 includes an output port 61 that is fluidically connected to an associated ink feed conduit 17. The output port 61 can be located for example at a lower portion of the ink refill chamber 53. An output control valve 91 can be provided at the output port 61 of each refill chamber 53.

The main ink chamber 51 and the ink refill chambers 53 can be heated by a heating system 65 to maintain the melted solid ink 33 within a predetermined temperature range. The heating system 65 can be contactive, convective or radiant, for example.

A pressurizing mechanism 63 selectively individually pressurizes the ink refill chambers 53, for example as controlled by the controller 10, to cause melted ink to flow to the printhead assemblies 20.

In use, when an ink refill chamber 53 is not being pressurized, it is vented to ambient pressure so that ink can flow from the main chamber 51 to the ink refill chamber 53. When an ink refill chamber is pressurized, melted solid ink is forced into the associated ink supply conduit 17, for example by opening the output control valve 91.

Figure 5:
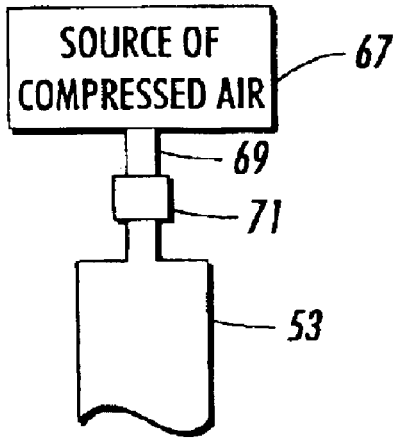
FIG. 5 is a schematic block diagram of an embodiment of a pressurizing mechanism for pressurizing ink in ink refill chambers of the ink container of FIG. 4.

FIG. 5 is a schematic block diagram of an embodiment of a pressurizing mechanism that includes a source of compressed air 67, a respective air channel 69 connected between the source of compressed air 67 and each ink refill chamber 53, and a valve 71 that controls the flow of compressed air to the ink refill chamber 53. The valve 71 can be controlled by the controller 10 (FIGS. 1 and 2).

Figure 6:
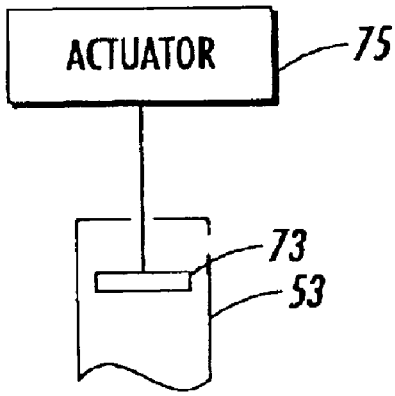
FIG. 6 is a schematic block diagram of an embodiment of another pressurizing mechanism for pressurizing ink in ink refill chambers of the ink container of FIG. 4.

FIG. 6 is a schematic block diagram of an embodiment of a pressurizing mechanism that includes a piston 73 disposed in an ink refill chamber 53 and an actuator 75 that selectively actuates the piston 73. The actuator 73 can be controlled by the controller 10 (FIGS. 1 and 2).

The invention has been described with reference to disclosed embodiments, and it will be appreciated that variations and modifications can be affected within the spirit and scope of the invention.

What is claimed is:

1. An ink container comprising:

a main ink chamber for containing ink;

a plurality of ink refill chambers respectively fluidically connected to the main ink chamber for receiving ink from the main ink chamber;

a plurality of one-way valves for respectively permitting a flow of ink from the main ink chamber to the plurality of ink refill chambers;

a plurality of output conduits for respectively conveying ink from the plurality of ink refill chambers; and a mechanism for respectively selectively pressurizing the plurality of ink refill chambers to cause ink to selectively flow into the plurality of output conduits.

2. The ink container of claim 1 wherein the main ink chamber is heated.

3. The ink container of claim 1 wherein the plurality of ink refill chambers are heated.

4. The ink container of claim 1 further including a plurality of conduits respectively connected between the main ink chamber and the plurality of ink refill chambers.

5. The ink container of claim 1 further including a plurality of conduits respectively connected between the main ink chamber and the plurality of ink refill chambers, and wherein the plurality of one-way valves are respectively disposed at respective ends of the plurality of conduits that are located at the plurality of ink refill chambers.

6. The ink container of claim 1 further including a plurality of conduits respectively connected between a lower portion of the main ink chamber and lower portions of the plurality of ink refill chambers.

7. The ink container of claim 1 further including a plurality of conduits respectively connected between a lower portion of the main ink chamber and lower portions of the plurality of ink refill chambers, and wherein the plurality of one-way valves are respectively disposed at respective ends of the plurality of conduits that are located at the lower portions of the plurality of ink refill chambers.

8. The ink container of claim 1 wherein the mechanism for pressurizing the ink in the plurality of ink refill chambers comprises a plurality of pistons.

9. The ink container of claim 1 wherein the mechanism for pressurizing the ink in the ink refill chambers comprises compressed air.

10. The ink container of claim 1 wherein the plurality of output conduits comprises a plurality of heated conduits.

11. An ink jet apparatus comprising:

a plurality of printheads;

a main ink chamber for containing ink;

a plurality of ink refill chambers respectively fluidically connected to the main ink chamber for receiving ink from the main ink chamber;

a plurality of one-way valves for respectively permitting a flow of ink from the main ink chamber to the plurality of ink refill chambers;

a plurality of conduits respectively connected between the plurality of ink refill chambers and the plurality of printheads; and a mechanism for respectively selectively pressurizing the plurality of ink refill chambers.

12. The ink jet apparatus of claim 11 further including an ink melter for providing melted solid ink to the main ink chamber.

13. The ink jet apparatus of claim 11 wherein the main chamber and the plurality of ink refill chambers are heated.

14. The ink jet apparatus of claim 11 wherein the plurality of conduits comprises a plurality of heated conduits.

15. The ink jet apparatus of claim 11 wherein the plurality of printheads comprises a plurality of piezo-electric printheads.

16. The ink jet apparatus of claim 11 wherein the pressurizing mechanism comprises a plurality of pistons.

17. The ink jet apparatus of claim 11 wherein the pressurizing mechanism comprises compressed air.

* * * * *